US009252495B1

(12) United States Patent
Jones, III

(10) Patent No.: US 9,252,495 B1
(45) Date of Patent: Feb. 2, 2016

(54) ULTRA-WIDEBAND ANTENNA WITH A CONICAL FEED STRUCTURE AND HYPERBOLIC COSINE TAPER

(71) Applicant: The United States of America as represented by the Secretary of the Navy, San Diego, CA (US)

(72) Inventor: Thomas O. Jones, III, San Diego, CA (US)

(73) Assignee: THE UNITED STATES OF AMERICA AS REPRESENTED BY THE SECRETARY OF THE NAVY, Washington, DC (US)

( * ) Notice: Subject to any disclaimer, the term of this patent is extended or adjusted under 35 U.S.C. 154(b) by 189 days.

(21) Appl. No.: 14/042,197

(22) Filed: Sep. 30, 2013

(51) Int. Cl.
*H01Q 13/04* (2006.01)
*H01Q 13/02* (2006.01)

(52) U.S. Cl.
CPC ..... *H01Q 13/04* (2013.01); *H01Q 13/02* (2013.01)

(58) Field of Classification Search
CPC ..... H01Q 13/00; H01Q 13/04; H01Q 13/06; H01Q 9/28; H01Q 21/0006; H01Q 21/08
USPC ..... 343/773, 772
See application file for complete search history.

(56) References Cited

U.S. PATENT DOCUMENTS

| | | | | |
|---|---|---|---|---|
| 6,667,721 | B1 * | 12/2003 | Simonds | 343/773 |
| 7,148,855 | B1 | 12/2006 | Homer et al. | |
| 7,408,521 | B2 * | 8/2008 | Smith et al. | 343/773 |
| 8,576,135 | B1 * | 11/2013 | Krivokapic | 343/773 |
| 8,654,025 | B1 * | 2/2014 | Brock et al. | 343/752 |
| 2007/0241980 | A1 | 10/2007 | Smith et al. | |

OTHER PUBLICATIONS

Schantz, Hans, "The Art and Science of Ultra-wideband Antennas", Artech House, London, pp. 204-205 (2005).
Lin et al., U.S. Appl. No. 13/861,127, entitled "High Gain Dish Antenna With a Tapered Slot Feed" (filed Apr. 11, 2013).

* cited by examiner

*Primary Examiner* — Hoang V Nguyen
(74) *Attorney, Agent, or Firm* — SPAWAR Systems Center Pacific; Kyle Eppele; Ryan J. Friedl

(57) ABSTRACT

An antenna is adapted for operation over a broadband frequency. The antenna includes a conical portion and a tapered portion. The conical portion may have a bicone structure, where each cone has a tapered portion. The tapered portion tapers asymptotically with an exponential.

10 Claims, 7 Drawing Sheets

800

| Freq. GHz | hyperbolic cosine taper | | | exponential taper | | |
|---|---|---|---|---|---|---|
| | Peak Directional Gain | 3 dB Beam Width Degrees | -3 dBi Beam Width Degrees | Peak Directional Gain | 3 dB Beam Width Degrees | -3 dBi Beam Width Degrees |
| 0.13 | 1.8 DBi @ 89° | 90.1° | 109.5° | 1.7 dBI | 90.3° | 109.5° |
| 0.2 | 1.7 DBI @ 87° | 91.6° | 100.34° | 1.7 DBI @ 86° | 92.2° | 110.7° |
| 0.3 | 1.3 DBi @ 104° | 104° | 118.5° | 1.3 DBi @ 106° | 106.5° | 119.7° |
| 0.4 | 2.2 DBi @ 120° | 68.8° | 130.14° | 2.3 DBI @ 121° | 66.3° | 130.5° |
| 0.5 | 2.2 DBI @ 72° | 72.4° | 141.16° | 2.3 DBI @ 121° | 72.8° | 95.8° |
| 0.6 | 3.1 DBi @ 149° | 35.2° | 112° | 3.0 DBi @ 146° | 87.9° | 104.2° |
| 0.7 | 3.1 DBI @ 149° | 35.2° | 112.6° | 3.3 DBI @ 149° | 35.6° | 111.3° |
| 0.8 | 2.2 DBI @150° | 33.4° | 124.7° | 2.7 DBi @ 151° | 32.45° | 125.8° |
| 0.9 | 1.9 DBi @ 107° | 81.9° | 127.15° | 2.2 DBi @ 152° | 78.9° | 128° |
| 1.0 | 2.7 DBI @ 117° | 65.1° | 127.7° | 2.9 DBI @ 118° | 37° | 127.5° |
| 1.1 | 3.0 DBI @ 120° | 27.2° | 98.68° | 3.1 DBi @ 121° | 27.6° | 132° |
| 1.2 | 2.2 DBI @ 121° | 76.3° | 88° | 2.4 DBI @ 122° | 76.6° | 98.4° |
| 1.4 | 1.6 DBI @ 106° | 91° | 98.9° | 2.7 DBI @ 107° | 90.7° | 98.8° |
| 1.6 | 2.0 DBi @ 79° | 94.9° | 101.6° | 1.9 DBi @ 108° | 93° | 100.4° |
| 1.8 | 2.3 DBI @ 93° | 73.8° | 108.15° | 2.5 DBI @ 93° | 72° | 104.5° |
| 1.9 | 2.6 DBi @ 97° | 74.7° | 87.34° | 2.9 DBI @ 97° | 72.1° | 85° |
| 2.0 | 3.0 DBi @ 91° | 55.6° | 93.53° | 3.1 DBi @ 91° | 55° | 91.8° |
| 2.2 | 3.2 DBI @ 95° | 60.8° | 95.2° | 3.3 DBI @ 95° | 48.9° | 95.5° |
| 2.4 | 3.1 DBi @ 87° | 49.2° | 93.55° | 3.2 DBi @ 85° | 48.4° | 80.55° |
| 2.6 | 2.9 DBI @ 83° | 54.3° | 85.3° | 2.9 DBi @ 90° | 53.9° | 86° |
| 2.8 | 3.3 DBI @ 85° | 46° | 90.9° | 3.4 DBI @ 85° | 43.9° | 76.9° |
| 3.0 | 3.4 DBi @ 87° | 45.3° | 86.61° | 3.5 DBi @ 89° | 40.8° | 98° |
| 3.2 | 3.5 DBI @ 87° | 46.0° | 81.33° | 3.5 DBI @ 88° | 44.8° | 100.4° |
| 3.6 | 3.3 DBI @ 91° | 45.9° | 83.5° | 3.4 DBI @ 91° | 44.4° | 90.6° |

FIG. 9

ULTRA-WIDEBAND ANTENNA WITH A CONICAL FEED STRUCTURE AND HYPERBOLIC COSINE TAPER

FEDERALLY-SPONSORED RESEARCH AND DEVELOPMENT

The United States Government has ownership rights in this invention. Licensing inquiries may be directed to Office of Research and Technical Applications, Space and Naval Warfare Systems Center, Pacific, Code 72120, San Diego, Calif. 92152; telephone (619)553-5118; email: ssc_t2@navy.mil. Reference Navy Case No. 101,814.

BACKGROUND

Standard bicone antenna designs have an insufficiently narrow operating frequency range which is not desirable in certain applications. In many cases, the feed regions where the two points of the cones meet does not employ a geometry supporting the standard required 50Ω impedance for proper operation when connected to a transmission line. As a result, the manufacturer typically places a resistor in between the two cones, which not only lowers the Voltage Standing Wave Ratio (VSWR), but also reduces effective antenna performance. In addition, the use of radial, flared and stepwise extensions from the bicone structure have resulted in significant ripple and undesirable lobes in antenna gain performance, both in azimuth and elevation patterns.

There is a need for an improved bicone antenna design that is suitable for a wide operating frequency range, such as from low Very High Frequency (VHF) through Super High Frequency (SHF), and that also provides high power handling.

SUMMARY

It should be appreciated that this Summary is provided to introduce a selection of concepts in a simplified form, the concepts being further described below in the Detailed Description. This Summary is not intended to identify key features or essential features of this disclosure, nor is it intended to limit the scope of the disclosure.

According to one embodiment, an antenna adapted for operation over a broadband frequency includes a conical portion and a tapered portion. The tapered portion tapers asymptotically with an exponential.

According to another embodiment, a method for providing an antenna for operating over a broadband frequency includes providing a conical portion and providing a tapered portion. The tapered portion tapers asymptotically with an exponential.

BRIEF DESCRIPTION OF THE DRAWINGS

The following description may be best understood from the accompanying drawings, in which similarly-referenced characters refer to similarly-referenced parts.

FIG. 9 is a table that compares performance of a bicone antenna having a cosh taper and a bicone antenna having an exponential taper.

DETAILED DESCRIPTION

A typical bicone antenna having a feed structure transitioning to an exponential taper has a modest discontinuity in the slope at the end of the cone and the beginning of the taper. This discontinuation in the slope can cause reflections that impact the impedance and the antenna pattern at high frequencies. This limits the frequency performance of the antenna.

According to illustrative embodiments, the frequency performance of a bicone antenna with an exponential taper is improved by eliminating the discontinuity in the slope while preserving the exponential nature of the taper. As described herein, the discontinuity in the slope may be eliminated through use of a cosh (also referred to as a hyperbolic cosine) taper given by $z(\rho)=\cosh(\alpha\rho)$ where z is the distance from the feed point on the symmetry axis of the antenna, ρ is the radial distance from the z-axis, and α is a constant that depends on the antenna impedance.

As an illustrative example, consider a bicone with a cone angle 23.2° relative to ρ axis. The impedance of such a bicone is given by:

$$Z = \frac{376.7}{\pi} * \ln(\cot(\theta_{hc}/2)), \quad \text{(Eq. 1)}$$

where $\theta_{hc}$ is half the cone angle (90°-23.20°=66.8°). The angle 23.2° is chosen for a design impedance of 50 Ω.

Figure 1:
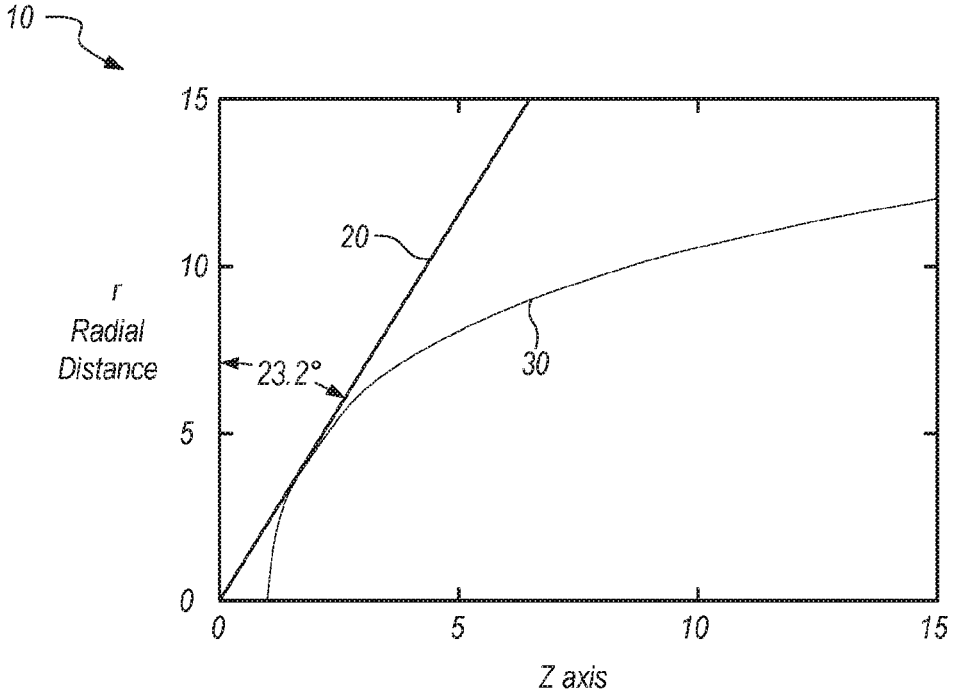
FIG. 1 shows a graph illustrating a comparison of a straight cone edge and a cosh tapered edge.

FIG. 1 shows a graph 10 illustrating a comparison of a straight edge cone slope and a cosh taper. FIG. 1 shows a line 20 with a 23.2° slope relative to the p axis, which corresponds to the straight cone slope. The function $z(\rho)=\cosh(\alpha\rho)$ with $\alpha=0.28405219233$ is also plotted as line 30. This corresponds to the cosh function. As can be seen in FIG. 1, the cosh function intersects the cone slope at about $z_0=1.8102$ and $\rho_0=4.2235$.

Figure 2:
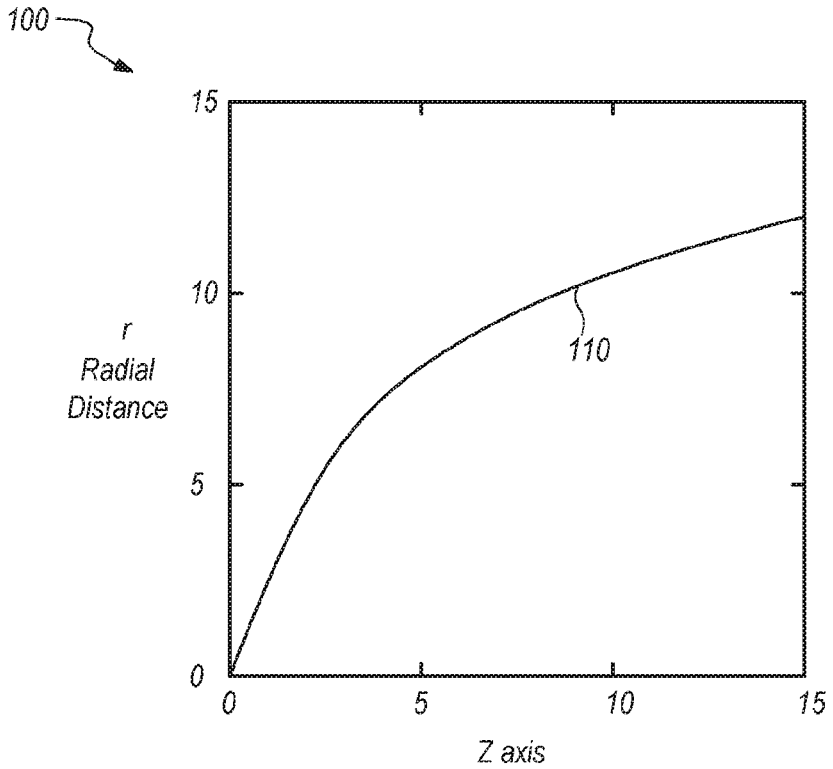
FIG. 2 shows a graph illustrating a shape of a cone feed having a combined straight portion with a cosh taper.
Figure 3:
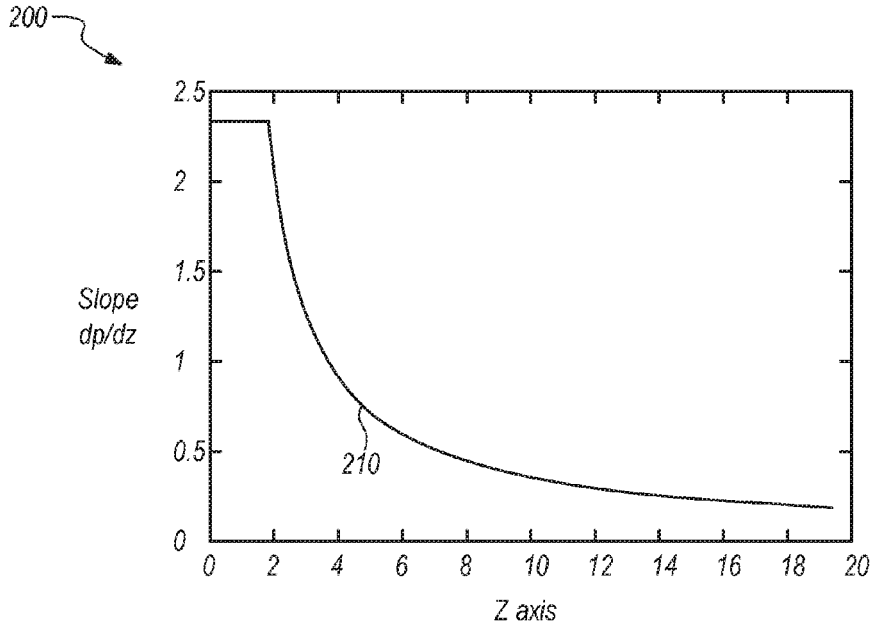
FIG. 3 shows a graph illustrating a slope of a taper as a function of a distance from the feed point.

FIG. 2 shows a graph 100 illustrating a cross-section of curves of a combined conical portion, tapering to a cosh shaped tapered portion 110. FIG. 3 shows a graph 200 depicting a line 210 with a slope dρ/dz as a function of z. As can be seen from FIG. 3, the slope drops very rapidly and tapers to a small value. The exponential taper can be made continuous if $$z(\rho) = z_0 e^{\left(\frac{\rho}{\rho_0}-1\right)}$$

where $$dz(\rho)/d\rho = \frac{z_0}{\rho_0} e^{\left(\frac{\rho}{\rho_0}-1\right)}.$$

This equation has the same slope as the initial cone when $$dz(\rho_0)/d\rho = \frac{z_0}{\rho_0} = \frac{1.8102}{4.2253} = 0.42842.$$

Figure 4:
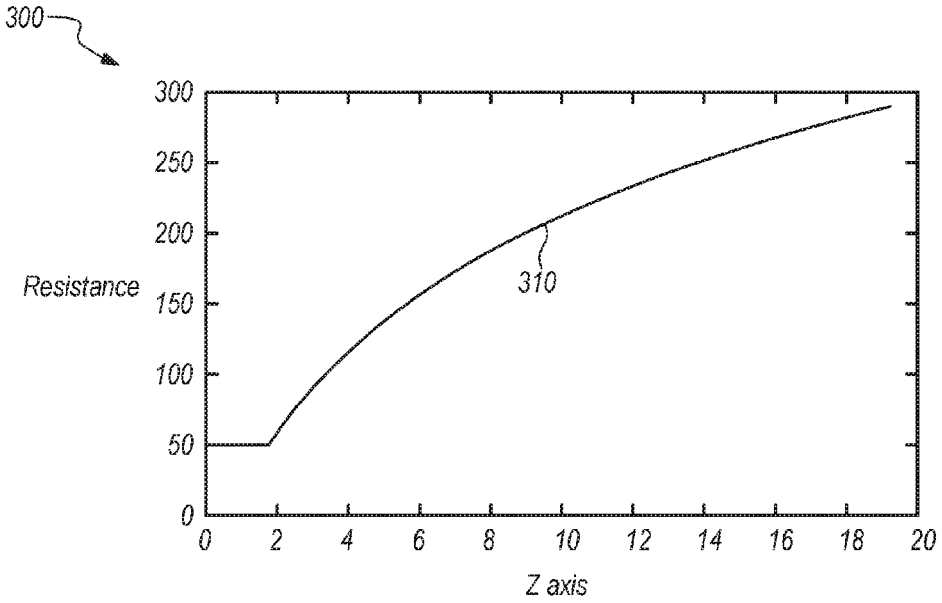
FIG. 4 shows a graph illustrating the impedance of a cone feed having a combined straight edge with a cosh taper.
Figure 5:
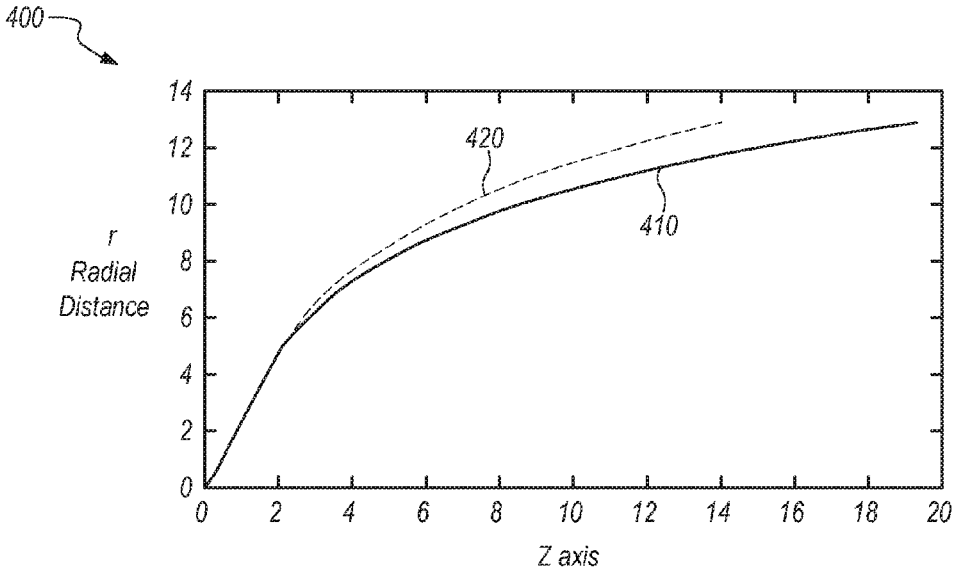
FIG. 5 shows a graph illustrating a comparison of shapes of an exponential taper and a cosh taper.
Figure 6:
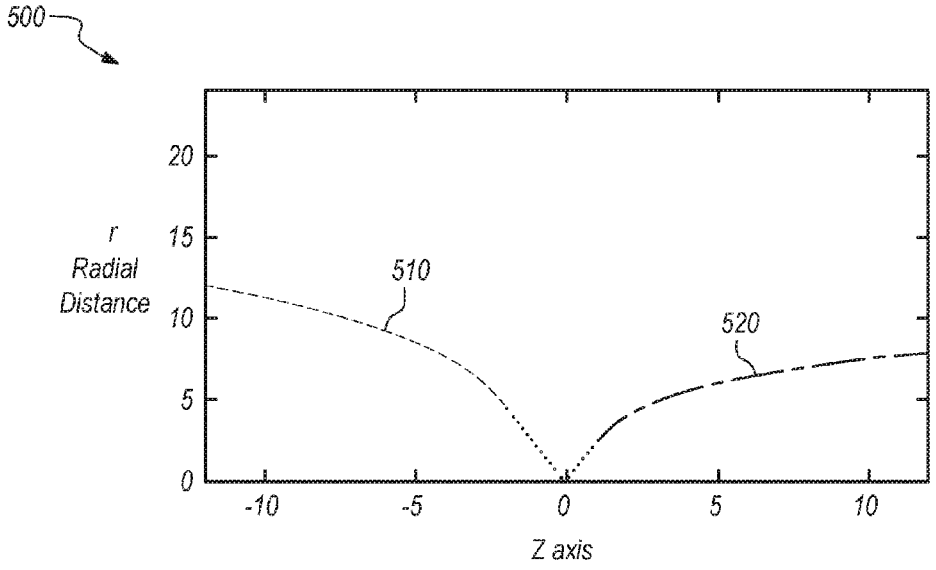
FIG. 6 shows a graph illustrating a cross-section of a bicone feed with a cosh taper.

FIG. 4 shows a graph 300 of the impedance, represented by line 310, computed from the slope of the antenna shape. This is a heuristic explanation of the impact of the changing slope. FIG. 5 shows a graph 400 of both a cosh taper, indicated by a solid curve 410, and an exponential taper, indicated by a dashed curve 420. As can be seen from FIG. 5, the cosh taper has a faster taper than the exponential taper. FIG. 6 shows a graph 500 depicting the cross-section of a bicone antenna, with cones represented by lines 510 and 520, with a cosh taper. As can be seen from FIG. 6, the edges of the bicone taper to a cosh-shaped taper.

Figure 7:
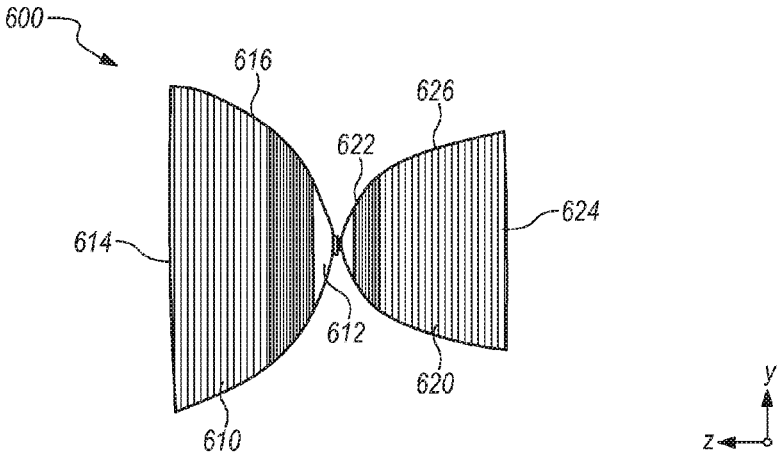
FIG. 7 illustrates a bicone feed antenna with a cosh taper modeled with a CST.
Figure 8:
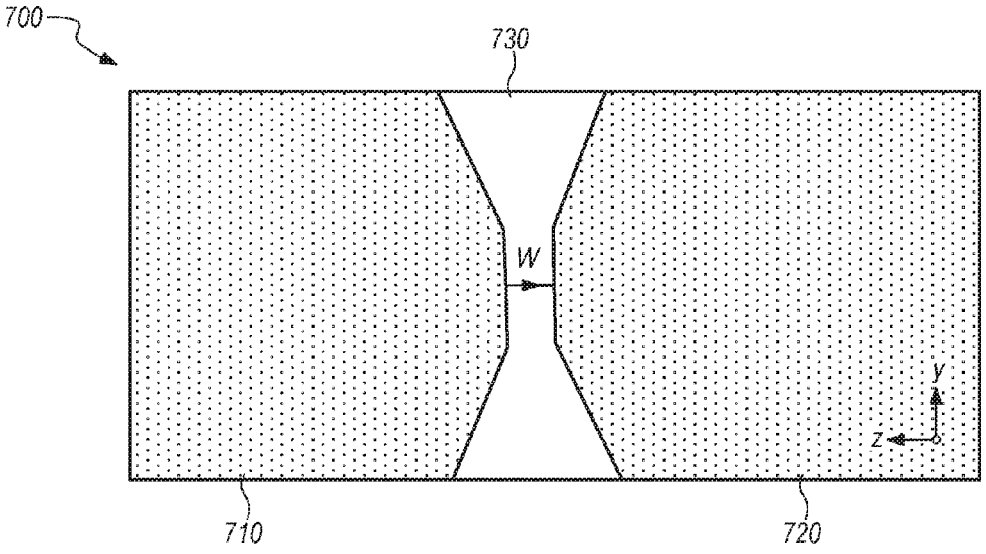
FIG. 8 illustrates another view of a bicone feed antenna with a cosh taper showing a feed point gap.

FIG. 7 shows an example of a bicone antenna 600 such as represented by the graph of FIG. 6. Antenna 600 includes a first cone 610 with a first end 612 and a second end 614, as well as a second cone 620 with a first end 622 and a second end 624. First end 612 and second end 622 are separated by a small gap such as shown in FIG. 8, with such gap serving as the feed point. As shown, each of cones 610 and 620 have an at least one tapered portion 616 and 626, respectively, with an asymptotic exponential taper.

In some embodiments, the tapered portion 616 and 626 tapers with an increasing asymptotic exponential shape from a minimum width at a proximal point closest to a first end of the conical portion, such as first ends 612 and 622, to a maximum width as a second end of the conical portion, such as second ends 614 and 624.

In some embodiments, tapered portion 616 and 626 tapers with a hyperbolic cosine shape. In some embodiments, tapered portion 616 and 626 tapers according to the function $$z(\rho)=\cosh(\alpha\rho)$$

where z is the distance from the feed point on a symmetry axis, ρ is a radial distance from a z-axis of the antenna, and α is a constant that depends on an impedance of the antenna.

In some embodiments, tapered portion 616 and 626 tapers according to the function $$z(\rho)=\cosh(\alpha(\rho-\rho_0))+\beta$$

where z is the distance from the feed point on a symmetry axis, ρ is a radial distance from a z-axis of the antenna, α is a constant associated with a taper rate of the tapered portion, and β is a constant associated with an intersection of the tapered portion with the z-axis.

In some embodiments, the tapered portion 616 and 626 tapers according to the function $$z(\rho)=\cosh(\alpha\rho)^{\eta}$$

where z is the distance from the feed point on a symmetry axis of the antenna, ρ is a radial distance from a z-axis of the antenna, α is a constant that depends on an impedance of the antenna, and η is greater than zero.

In some embodiments, the tapered portion 616 and 626 tapers according to a function that has a $e^{\rho}$ term in its asymptotic form, where ρ is a radial distance from a z-axis of the antenna, and the function is non-zero at ρ=0.

Referring to FIG. 8, FIG. 8 shows a diagram 700 illustrating an example of a feed point 730 between a first conical element 710 and a second conical element 720. Feed point 730 may be used for antenna 600 shown in FIG. 7. The feed point may be a simple gap with a 50Ω source. The 50Ω source has some inductance. The inductance can be reduced by using a wire having a radius of approximately 0.25" as a source in the feed point (having approximately a 0.12" gap).

A difference between a bicone antenna with an exponential taper and a bicone antenna with a cosh taper is the beam width at 1.0 GHz. Particularly, the −3 dB beam width is 45% smaller for the exponential taper at 1.0 GHz. This difference in beam width is caused by a relatively small change in the antenna pattern. This may be understood with reference to the table 800 shown in FIG. 9 which shows a comparison between beam widths of a bicone antenna with a cosh taper and beam widths of a bicone antenna with an exponential taper at different frequencies. Referring to FIG. 9, the 3 dB beam width is measured relative to the peak directional gain. This beam width depends on the peak gain value.

There are two 3 dB points lower than the peak gain, and each point is on of a different side of the peak (in this case above and below the peak, with the z-axis being vertical). The −3 dB points would be two different elevation angles on either side of the peak gain.

The −3 dBi beam width is measured relative to the isotropic gain. The 0 dBi is the reference level for the antenna output if energy radiates uniformly in all directions. The −3 dBi points would be two different elevation angles on either side of the peak gain. This beam width is less sensitive to the peak gain. This is why the 3 dB beam width is smaller than the −3 dBi beam width.

Figure 10:
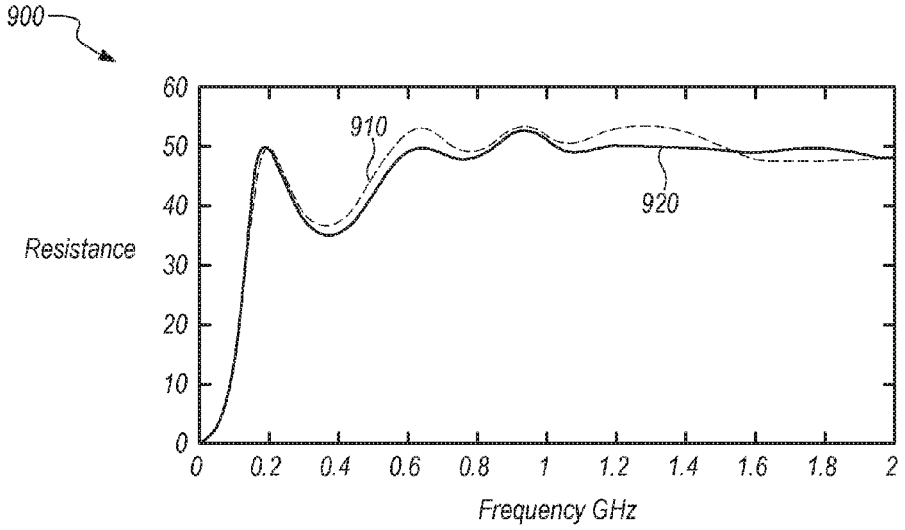
FIG. 10 illustrates a comparison of a resistance of a bicone feed antenna having an exponential taper and a bicone feed antenna having a cosh taper.
Figure 11:
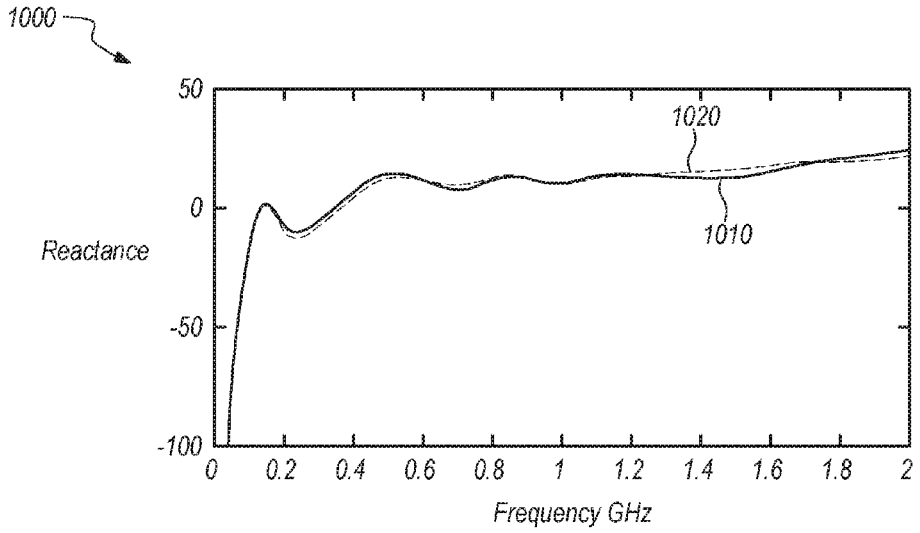
FIG. 11 illustrates a comparison of a reactance of a bicone feed antenna having an exponential taper and a bicone feed antenna having a cosh taper.

FIG. 10 shows a graph 900 illustrating the resistance of the exponentially tapered antenna, represented by the dashed line 910 and the cosh tapered antenna, represented by the solid line 920. FIG. 11 shows a graph 1000 illustrating the reactance of the exponentially tapered antenna, represented by the solid line 1010 and the cosh tapered antenna, represented by the dashed line 1020. As can be seen from these figures, the impedance of the hyperbolic taper is smoother than an exponential. The difference in impedance is caused by a localized difference in the voltage at the feed point. An introduction of a 50Ω coaxial model at the feed point improves the results for both models.

According to illustrative embodiments, the reflection at the transition from the cone to the taper of the antenna is greatly reduced according to illustrative embodiments. Compared to a bicone antenna with an exponential taper, in which the bicone size was determined by the 1 GHz operation frequency requirement, according to the disclosed embodiments with the asymptotic exponential taper, the bicone size plays an insignificant role. The antenna design depends only on the height and diameter of each dipole arm (including the combined cone and the taper)

Although a cosh taper is described above, it should be appreciated that there are several variations for a tapered shape that will produce results better than an exponential taper. The hyperbolic cosine function is rotationally symmetric about the z-axis. The function $z(\rho)=\cosh(\alpha(\rho-\rho_0))+\beta$ is one alternative, where $\alpha>0$ and $\beta>-1$. According to this alternative, α refers to a change a taper rate and β refers to a change in the function's intersection with the z-axis. Both $\alpha$ and $\beta$ determine an intersection point of for the cone and the taper. For a given value of $\beta$, there is only one value of a that causes the function to intersect the cone at only one point. Another alternative taper function is $z(\rho)=\cosh(\alpha\rho)^{\eta}$ where $\eta>0$.

All of the above equations have an exponential asymptotic form. In fact, any function that has an $e^{\rho}$ term in its asymptotic form and has a non-zero at $\rho=0$ would work. For example, a Modified Bessel function $I_0(\rho)$ and Modified Spherical Bessel function $i_0(\rho)$ would work for that taper.

Figure 12:
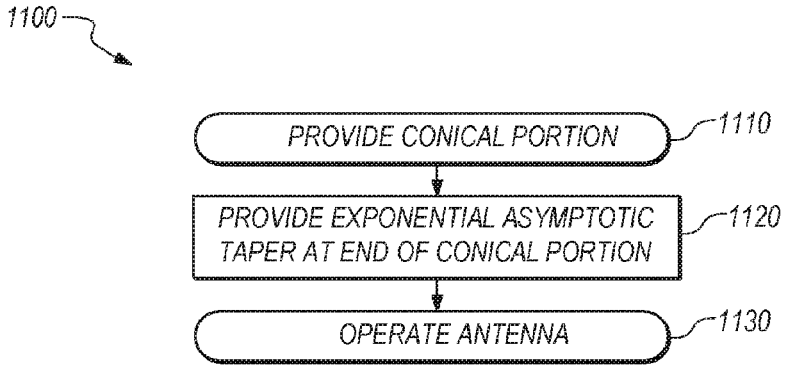
FIG. 12 illustrates a method for providing an antenna for operating over a wideband frequency according to an illustrative embodiment.

FIG. 12 illustrates a method 1100 for providing an antenna for operating over a wideband frequency according to an illustrative embodiment. Referring to FIG. 12, method 1100 begins at step 1110 at which a conical portion is provided, such as a bicone portion. At step 1120, a tapered portion is provided, where the tapered portion tapers asymptotically with an exponential. It should be appreciated that steps 1110 and 1120 may be performed at the same time, with the conical portion fabricated with the tapered portion, or that the tapered portion may be connected to the conical portion. In the case of a bicone portion, a tapered portion would be connected (or fabricated at the same time as) each bicone portion. At step 1130, the antenna is operated, e.g., by supplying power to a feed point connected between the bicones.

It will be understood that many additional changes in the details, materials, steps, and arrangement of parts, which have been described herein and illustrated to explain the nature of the embodiments of the invention, may be made by those skilled in the art within the principle and scope of the embodiments of the invention as expressed within the appended claims.

I claim:

1. An antenna comprising:

a conical element having at least one tapered portion that tapers according to a function that has an $e^{\rho}$ term in its asymptotic form, where $\rho$ is a radial distance from a z-axis of the antenna, and the function is non-zero at $\rho=0$.

2. The antenna of claim 1, wherein the conical element comprises a bicone structure having two cones.

3. The antenna of claim 2, wherein each of the two cones has a tapered that tapers according to a function that has an $e^{\rho}$ term in its asymptotic form, where $\rho$ is a radial distance from a z-axis of the antenna, and the function is non-zero at $\rho=0$, wherein the tapered portions for the two cones are not equal.

4. The antenna of claim 1, wherein the tapered portion tapers from a minimum width at a proximal point closest to a first end of the conical portion to a maximum width as a second end of the conical portion.

5. The antenna of claim 1, wherein the tapered portion tapers with a hyperbolic cosine shape.

6. The antenna of claim 1, wherein the tapered portion tapers according to the function $$z(\rho)=\cosh(\alpha\rho)$$

where z is the distance from the feed point on a symmetry axis, $\rho$ is a radial distance from a z-axis of the antenna, and $\alpha$ is a constant that depends on an impedance of the antenna.

7. The antenna of claim 1, wherein the tapered portion tapers according to the function $$z(\rho)=\cosh(\alpha(\rho-\rho_0))+\beta$$

where z is the distance from the feed point on a symmetry axis, $\rho$ is a radial distance from a z-axis of the antenna, $\alpha$ is a constant associated with a taper rate of the tapered portion, and $\beta$ is a constant associated with an intersection of the tapered portion with the z-axis.

8. The antenna of claim 1, wherein the tapered portion tapers according to the function $$z(\rho)=\cosh(\alpha\rho)^{\eta}$$

where z is the distance from the feed point on a symmetry axis of the antenna, $\rho$ is a radial distance from a z-axis of the antenna, $\alpha$ is a constant that depends on an impedance of the antenna, and $\eta$ is greater than zero.

9. The antenna of claim 1, wherein the tapered portion tapers according to a Modified Bessel function.

10. An antenna comprising:

a bicone structure having two cones, each cone having a tapered portion that tapers according to the function $$z(\rho)=\cosh(\alpha\rho)$$

where z is the distance from the feed point on a symmetry axis, $\rho$ is a radial distance from a z-axis of the antenna, and $\alpha$ is a constant that depends on an impedance of the antenna.

* * * * *